US009414733B2

(12) United States Patent
Vail et al.

(10) Patent No.: US 9,414,733 B2
(45) Date of Patent: Aug. 16, 2016

(54) FLOOR CLEANING MACHINE

(71) Applicant: Techtronic Industries Co. Ltd., Tsuen Wan, New Territories (HK)

(72) Inventors: Kevin Vail, North Royalton, OH (US); Gavin Burnham, Birmingham (GB); Jennifer Kathryn Marsden, Birmingham (GB); John Bantum, Munroe Falls, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 15 days.

(21) Appl. No.: 14/333,035

(22) Filed: Jul. 16, 2014

(65) Prior Publication Data

US 2015/0020346 A1 Jan. 22, 2015

Related U.S. Application Data

(60) Provisional application No. 61/846,879, filed on Jul. 16, 2013.

(51) Int. Cl.

| | |
|---|---|
| ***A47L 11/40*** | (2006.01) |
| ***A47L 5/30*** | (2006.01) |
| ***A47L 5/32*** | (2006.01) |

(Continued)

(52) U.S. Cl.

CPC ..... *A47L 11/4016* (2013.01); *A47L 5/30* (2013.01); *A47L 5/32* (2013.01); *A47L 7/0004* (2013.01); *A47L 9/22* (2013.01); *A47L 9/248* (2013.01); *A47L 11/34* (2013.01); *A47L 11/4044* (2013.01); *A47L 11/4083* (2013.01)

(58) Field of Classification Search

CPC ..... A47L 5/25; A47L 5/32; A47L 7/0004; A47L 9/248; A47L 11/34; A47L 11/4016
USPC ..... 15/320
IPC ..... A47L 11/40
See application file for complete search history.

(56) References Cited

U.S. PATENT DOCUMENTS 6,647,578 B2 11/2003 Morgan et al.
7,377,009 B2 † 5/2008 Lee (Continued)

OTHER PUBLICATIONS

Bissell, "Trilogy 81M9 Series, Service Guide," 2 pages, publication date unknown.

(Continued)

*Primary Examiner* — David Redding
(74) *Attorney, Agent, or Firm* — Michael Best & Friedrich LLP

(57) ABSTRACT

A floor cleaning machine for cleaning a surface includes a body having a suction nozzle thereon, a handle pivotably coupled to the body and having a motor housing portion, and a suction motor assembly operable to draw fluid and dirt from the surface through the suction nozzle. The floor cleaning machine also includes a recovery tank coupled to the handle in fluid communication with the suction motor assembly to receive and store fluid and dirt drawn through the suction nozzle and an expandable hose fluidly communicating the recovery tank and the suction nozzle. The hose is in one of a retracted configuration and an expanded configuration when the handle is pivoted to a substantially upright position, and the other when pivoted to a reclined position. The hose at least partially wraps around the motor housing portion when in the expanded configuration.

18 Claims, 5 Drawing Sheets

(51) Int. Cl.

| | |
|---|---|
| ***A47L 7/00*** | (2006.01) |
| ***A47L 9/22*** | (2006.01) |
| ***A47L 9/24*** | (2006.01) |
| ***A47L 11/34*** | (2006.01) |

(56) References Cited

U.S. PATENT DOCUMENTS 7,823,250 B2 11/2010 Vander Baan
2009/0271941 A1 † 11/2009 Coburn

OTHER PUBLICATIONS

Bissell, "Trilogy 81M9 Series, User's Guide," 20 pages, publication date unknown.
Trilogy 81M9 Series User's Guide, 20 pages, Bissell Homecare, Inc, Grand Rapids, Michigan, May 2012.†
Trilogy 81M9 Series Service Guide, 2 pages, Bissell Homecare, Inc., Jun. 2012.†

† cited by third party

FLOOR CLEANING MACHINE

CROSS-REFERENCE TO RELATED APPLICATIONS

This application claims priority to U.S. Provisional Application No. 61/846,879, filed on Jul. 16, 2013, the entire contents of which are incorporated herein by reference.

FIELD OF THE INVENTION

The present invention relates to floor cleaning machines and, more particularly, to floor cleaning machines that distribute cleaning fluid onto a surface.

BACKGROUND OF THE INVENTION

A floor cleaning machine, such as an extractor, typically sprays or otherwise distributes cleaning fluid onto a surface to wash the surface. The machine then draws the cleaning fluid and dirt from the surface into a recovery tank. Some floor cleaning machines can also deliver water to the surface to rinse the surface before and/or after the cleaning fluid is applied.

SUMMARY OF THE INVENTION

The invention provides, in one aspect, a floor cleaning machine for cleaning a surface. The floor cleaning machine includes a body having a suction nozzle thereon, a handle pivotably coupled to the body and having a motor housing portion, a supply tank assembly coupled to the handle, and a suction motor assembly in fluid communication with the suction nozzle and positioned in the motor housing portion. The suction motor assembly is operable to draw fluid and dirt from the surface through the suction nozzle. The floor cleaning machine also includes a recovery tank coupled to the handle in fluid communication with the suction motor assembly to receive and store fluid and dirt drawn through the suction nozzle and an expandable hose fluidly communicating the recovery tank and the suction nozzle. The hose is in one of a retracted configuration and an expanded configuration when the handle is pivoted to a substantially upright position. The hose is in the other of the retracted configuration and the expanded configuration when the handle is pivoted to a reclined position. The hose at least partially wraps around the motor housing portion when in the expanded configuration.

Other features and aspects of the invention will become apparent by consideration of the following detailed description and accompanying drawings.

Figure 1:
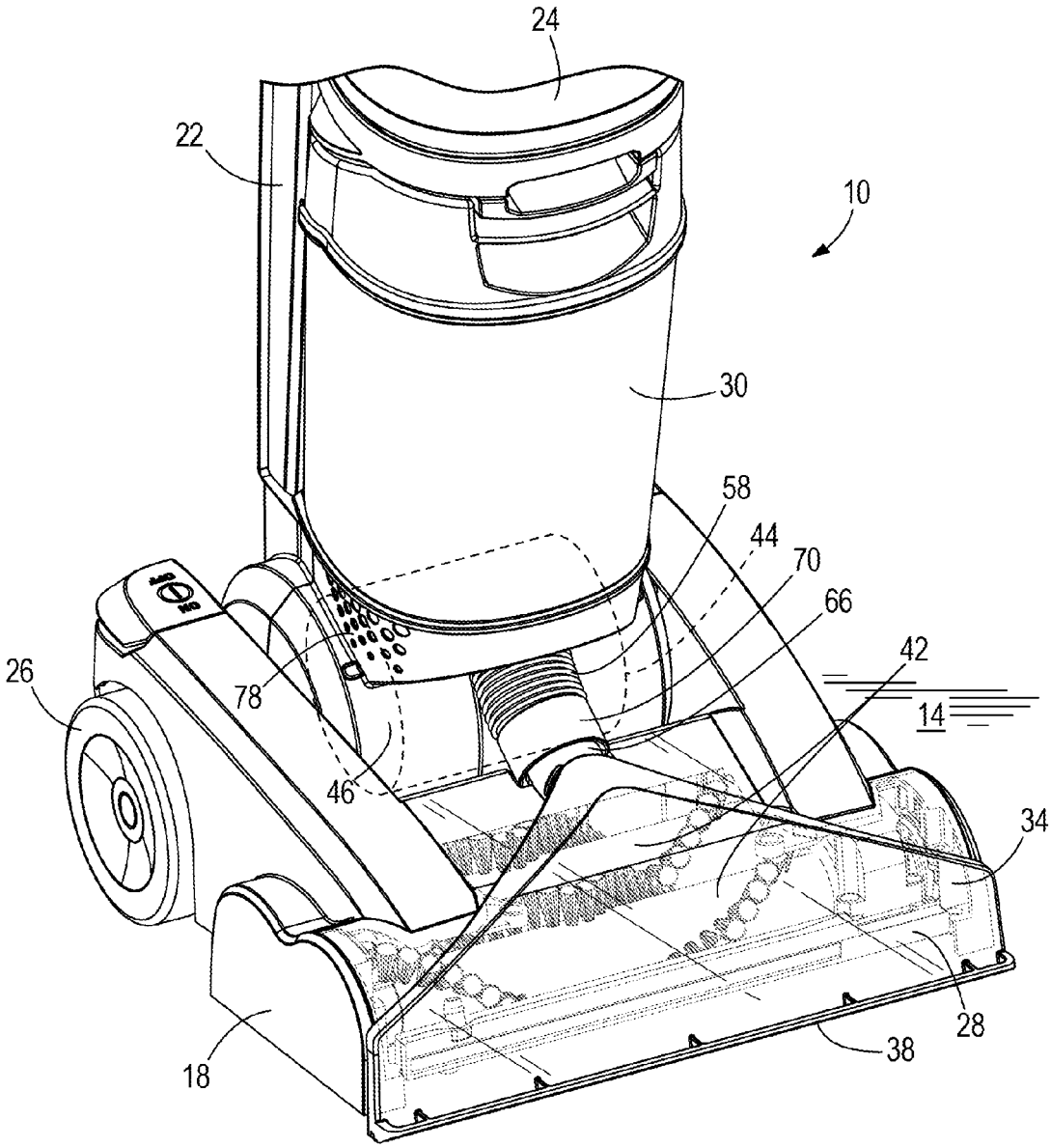
FIG. 1 is a top perspective view of a floor cleaning machine in accordance with an embodiment of the invention shown in a substantially upright position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate a floor cleaning machine, such as an extractor 10. In the illustrated embodiment, the extractor 10 is an upright extractor 10 operable to a clean a surface 14, such as, for example, a floor. In some embodiments, the extractor 10 may be adapted to clean a variety of surfaces 14, such as carpets, hardwood floors, tiles, or the like. The extractor 10 distributes or sprays cleaning fluid onto the surface 14 to clean the surface 14. The extractor 10 then draws the cleaning fluid and any dirt from the surface 14, leaving the surface 14 relatively clean and dry. As used herein, "cleaning fluid" refers to a detergent, a sanitizer, or a mixture of water and detergent/sanitizer.

The extractor 10 includes a body configured as a base or foot 18 and a handle 22 pivotably coupled to the foot 18. The foot 18 includes wheels 26 to facilitate movement of the foot 18 along the surface 14. In the illustrated embodiment, the wheels 26 are non-powered wheels 26. In other embodiments, however, any of the wheels 26 may be driven. The handle 22 extends from the foot 18 and is pivotable between a substantially upright storage position (shown in FIGS. 1 and 3) and a reclined operating position (shown in FIGS. 2 and 4). Pivoting the handle 22 to a reclined operating position facilitates moving (e.g., pushing and pulling) the foot 18 along the surface 14.

The extractor 10 includes a supply tank assembly 24 coupled to the handle 22 and a distribution nozzle 28 that directs cleaning solution from the supply tank assembly 24 onto the surface 14. The supply tank assembly 24 is removable from the extractor handle 22 and may include a handle to facilitate transport and handling of the supply tank assembly 24 apart from the extractor handle 22. The supply tank assembly 24 may include two or three supply tanks, each of which defining a discrete volume for separately storing one or more cleaning solutions and/or water. For example, a first supply tank may store a detergent, a second supply tank may store a sanitizer, and a third supply tank may store water. Each of the supply tanks may include an outlet that communicates with a distributor for drawing the corresponding fluid from the supply tanks, mixing the fluids, and directing the mixed fluids to the distribution nozzle 28. The outlets of the supply tanks may also be used to refill the supply tanks when the supply tank assembly 24 is removed from the handle 22.

With reference to FIGS. 1-4, the extractor 10 also includes a recovery tank 30 coupled to the handle 22 below the supply tank assembly 24 and a suction nozzle 34 coupled to the foot 18 that draws fluid and dirt from the surface 14 back into the recovery tank 30. The suction nozzle 34 is supported by a front portion of the foot 18 and includes a downward-facing inlet 38 adjacent the surface 14 to be cleaned. The recovery tank 30 is removable from the handle 22 and temporarily stores fluid and dirt drawn up from the surface 14 being cleaned through the suction nozzle 34. When full, the recovery tank 30 may be removed from the handle 22 and emptied. In some embodiments of the extractor 10, one or more electrically- or pneumatically-actuated brushes 42 may also be supported on the lower surface of the foot 18 adjacent the distribution nozzle 28 and/or the suction nozzle 34.

The extractor 10 further includes a suction motor assembly 44 in fluid communication with the suction nozzle 34 for drawing fluid and dirt from the surface 14 being cleaned through the suction nozzle 34 and into the recovery tank 30. The suction motor assembly 44 includes a fan that generates a vacuum to draw the fluid and dirt through the suction nozzle 34. In the illustrated embodiment, the suction motor assembly 44 is supported by and positioned within a motor housing portion 46 of the handle 22. As shown in FIGS. 1-4, the motor housing portion 46 includes a substantially cylindrical shape with a central axis 50 (FIG. 2) extending in a lateral direction relative to the foot 18. In the illustrated embodiment of the extractor 10, the central axis 50 also coincides or is coaxial with a pivot axis 54 between the handle 22 and the foot 18. Alternatively, the central axis 50 of the motor housing portion 46 and the pivot axis 54 between the handle 22 and the foot 18 may be offset.

The extractor 10 also includes an expandable hose 58 fluidly communicating the recovery tank 30 and the suction nozzle 34 for delivering fluid and dirt from the suction nozzle 34 to the recovery tank 30. In the illustrated embodiment, the hose 58 is configured as a flexible and expandable bellows-type plastic hose 58. Alternatively, the hose 58 may have any of a number of different configurations and be made from any of a number of different materials. In the illustrated embodiment, the hose 58 includes an inlet 62 (FIG. 4) attached to an outlet 66 of the suction nozzle 34 via a collar 70. The collar 70 may be detached from the suction nozzle outlet 66, if desired, for clearing debris from the hose 58. Alternatively, the collar 70 may be permanently secured to the suction nozzle outlet 66, or the hose inlet 62 may be directly attached to the suction nozzle outlet 66. In the illustrated embodiment, the hose 58 extends through an opening 74 (FIGS. 2 and 4) in a recovery tank support portion 78 of the handle 22, and an outlet of the hose 58 is interfaced and in fluid communication with an inlet of the recovery tank 30. The hose outlet is secured to the recovery tank support portion 78 of the handle 22 via a fitting into which the hose 58 is threaded or otherwise connected.

Figure 2:
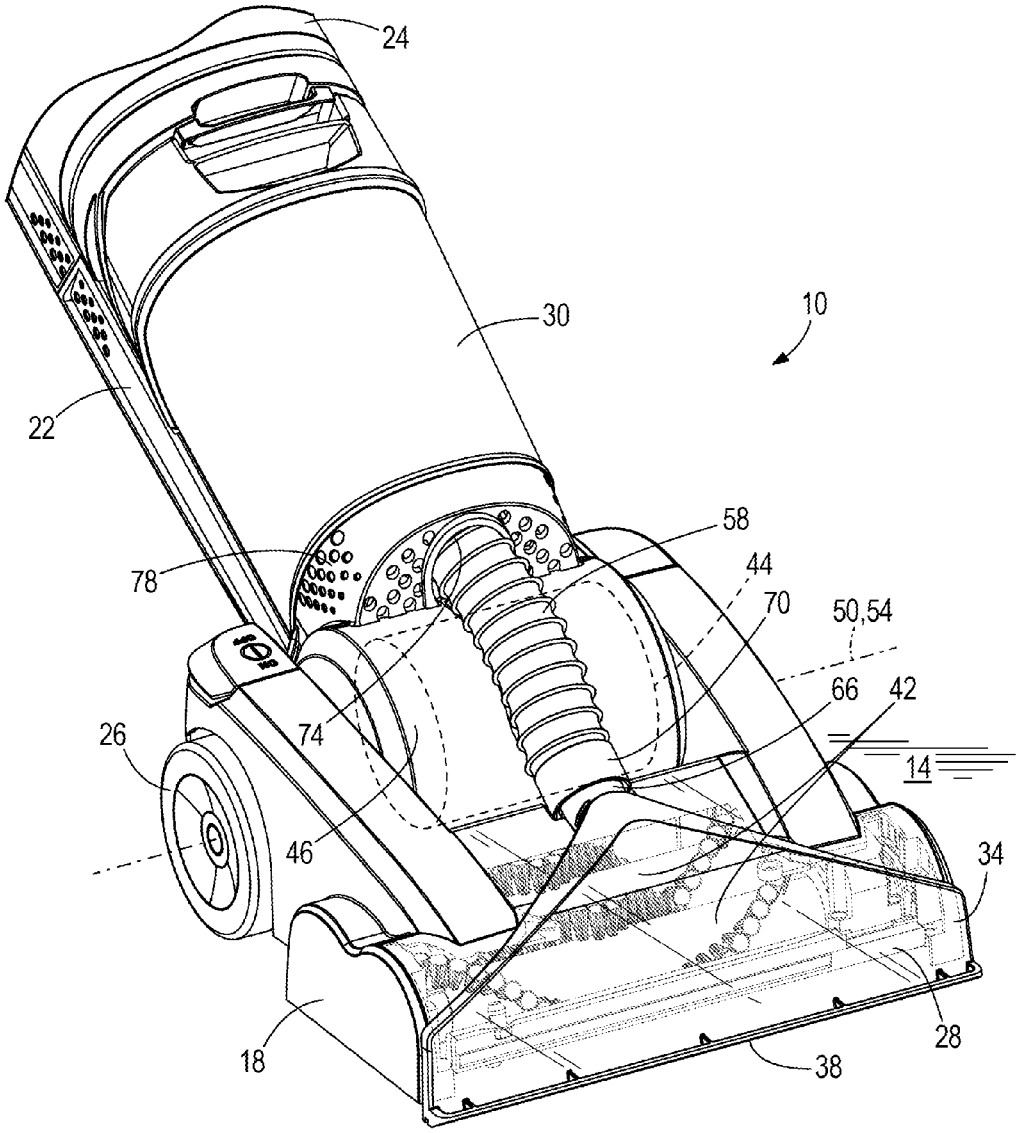
FIG. 2 is a top perspective view of the floor cleaning machine of FIG. 1 shown in a partially reclined position.
Figure 3:
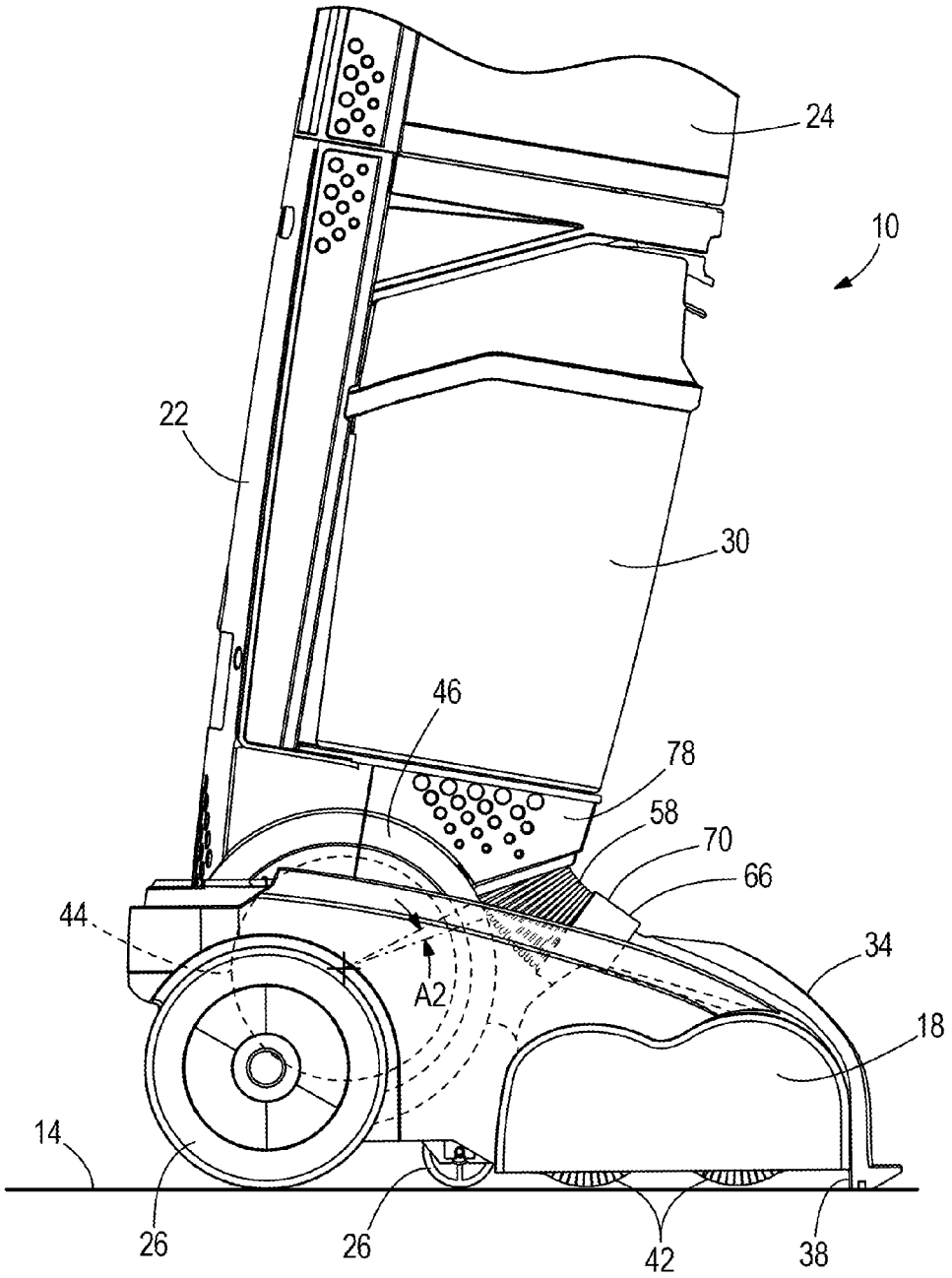
FIG. 3 is a side view of the floor cleaning machine of FIG. 1 shown in the substantially upright position.
Figure 4:
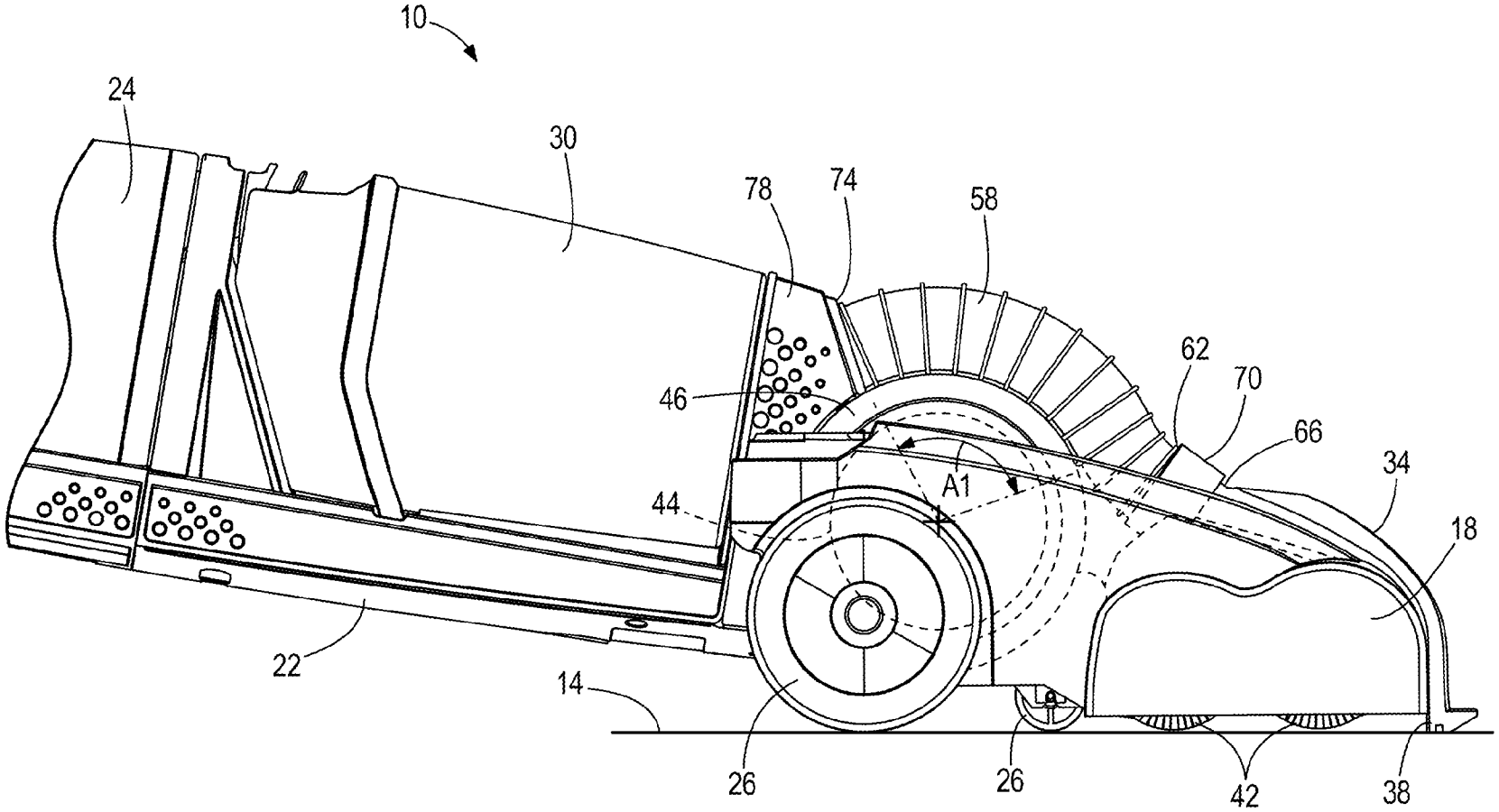
FIG. 4 is a side view of the floor cleaning machine of FIG. 1 shown in a fully reclined position.

With continued reference to FIGS. 1-4, because the hose inlet 62 is affixed to the suction nozzle 34 and the hose outlet is affixed to the recovery tank support portion 78 of the handle 22, the middle portion of the hose 58 is expandable and stretchable over the motor housing portion 46 when the handle 22 is pivoted between an upright storage position (shown in FIGS. 1 and 3) and a reclined operating position (shown in FIGS. 2 and 4). In other words, the hose 58 is in a retracted configuration when the handle 22 is pivoted to the upright storage position, and the hose 58 is in an expanded configuration in which it at least partially wraps around the motor housing portion 46 when the handle 22 is pivoted to a reclined operating position.

With reference to FIG. 4, the hose 58 assumes a substantially arcuate shape when in the expanded configuration to follow the substantially cylindrical shape of the motor housing portion 46. When the handle 22 is pivoted to the fully reclined operating position shown in FIG. 4, the hose 58 wraps around an arc length A1 of the motor housing portion 46 of at least about 90 degrees when in the expanded configuration. In other embodiments, the hose 58 may wrap around an arc length A1 of the motor housing portion 46 of at least about 60 degrees, at least about 45 degrees, or least about 30 degrees when in the expanded configuration. In yet other embodiments, the hose 58 may wrap around an arc length A1 of the motor housing portion 46 greater than about 90 degrees when in the expanded configuration.

When the handle 22 is pivoted to the substantially upright storage position shown in FIG. 3, the hose 58 wraps around an arc length A2 of the motor housing portion 46 of about 10 degrees or less when in the retracted configuration. In other embodiments, the hose 58 may wrap around an arc length A2 of the motor housing portion 46 of about 15 degrees or less, about 20 degrees or less, about 25 degrees or less, or about 30 degrees or less when in the retracted configuration. In yet other embodiments, the hose 58 may wrap around an arc length A2 of the motor housing portion 46 of less than about 10 degrees when in the retracted configuration.

As shown in FIGS. 2 and 4, the hose 58 is engageable with the motor housing portion 46 when the hose 58 is in the expanded configuration. The hose 58 is also slidably engageable with the motor housing portion 46 as the hose 58 expands and contracts between the expanded configuration and the retracted configuration, coinciding with movement of the handle 22 between the reclined position and the substantially upright position.

Figure 5:
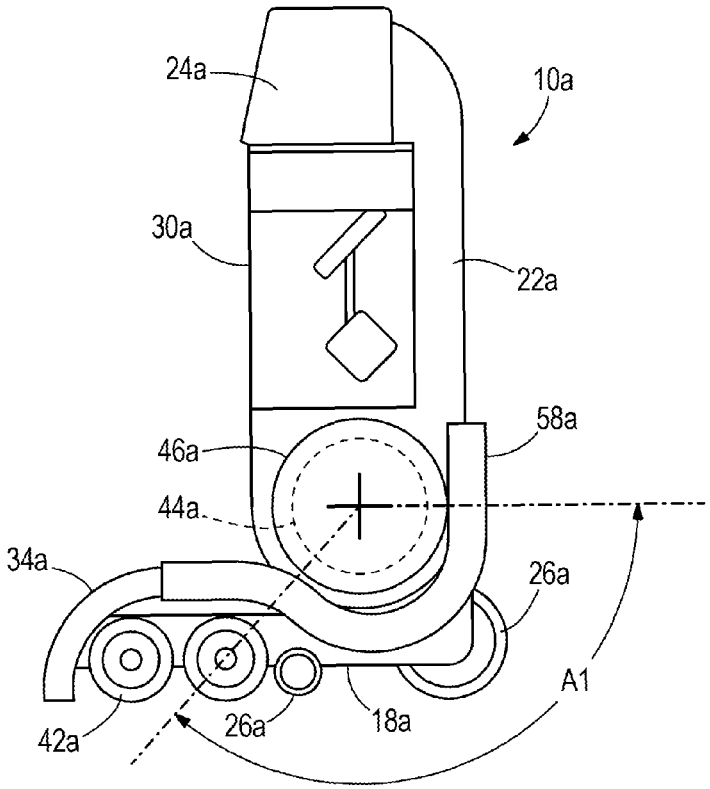
FIG. 5 is a side view of a floor cleaning machine in accordance with another embodiment of the invention shown in a substantially upright position.
Figure 6:
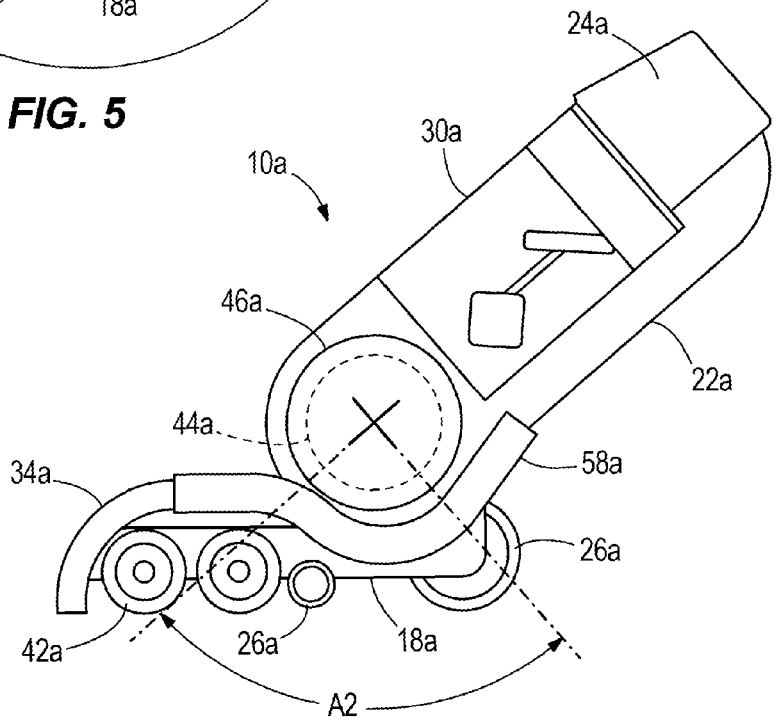
FIG. 6 is a side view of the floor cleaning machine of FIG. 5 shown in a reclined position.

FIGS. 5 and 6 illustrate another embodiment of a floor cleaning machine or extractor 10*a*, with like components and features being shown with like reference numerals with the letter "a." Rather than routing the hose 58*a* adjacent the top or front of the motor housing portion 46*a*, the hose 58*a* is routed adjacent the bottom or rear of the motor housing portion 46*a*. As a result, the hose 58 assumes a retracted configuration when the handle 22*a* is pivoted to a reclined position (FIG. 6), and an expanded configuration when the handle 22*a* is pivoted to a substantially upright position (FIG. 5). In the expanded configuration of the hose 58*a*, the hose 58*a* wraps around an arc length A1 of the motor housing portion 46*a* of at least about 130 degrees. In other embodiments, the hose 58*a* may wrap around an arc length A1 of the motor housing portion 46*a* of at least about 120 degrees, at least about 90 degrees, or least about 60 degrees when in the expanded configuration. In yet other embodiments, the hose 58*a* may wrap around an arc length A1 of the motor housing portion 46*a* greater than about 130 degrees when in the expanded configuration.

In the retracted configuration of the hose 58*a*, the hose 58*a* wraps around an arc length A2 of the motor housing portion 46*a* of about 90 degrees or less. In other embodiments, the hose 58*a* may wrap around an arc length A2 of the motor housing portion 46*a* of about 75 degrees or less, about 60 degrees or less, about 45 degrees or less, or about 30 degrees or less when in the retracted configuration. In yet other embodiments, the hose 58*a* may wrap around an arc length A2 of the motor housing portion 46*a* of about 30 degrees or less when in the retracted configuration.

Although the invention has been described in detail with reference to certain preferred embodiments, variations and modifications exist within the scope and spirit of one or more independent aspects of the invention as described.

What is claimed is:

1. A floor cleaning machine for cleaning a surface, the floor cleaning machine comprising:

a body including a suction nozzle thereon;

a handle pivotably coupled to the body, the handle including a motor housing portion;

a supply tank assembly coupled to the handle;

a suction motor assembly in fluid communication with the suction nozzle and positioned in the motor housing portion, the suction motor assembly operable to draw fluid and dirt from the surface through the suction nozzle;

a recovery tank coupled to the handle in fluid communication with the suction motor assembly to receive and store fluid and dirt drawn through the suction nozzle; and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the hose is in the retracted configuration when the handle is pivoted to the substantially upright position, and wherein the hose is in the expanded configuration when the handle is pivoted to the reclined position, and wherein the hose is engageable with the motor housing portion when the hose is in the expanded configuration.

2. A floor cleaning machine for cleaning a surface, the floor cleaning machine comprising:

a body including a suction nozzle thereon;

a handle pivotably coupled to the body, the handle including a motor housing portion;

a supply tank assembly coupled to the handle, a suction motor assembly in fluid communication with the suction nozzle and positioned in the motor housing portion, the suction motor assembly operable to draw fluid and dirt from the surface through the suction nozzle;

a recovery tank coupled to the handle in fluid communication with the suction motor assembly to receive and store fluid and dirt drawn through the suction nozzle; and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the hose is in the retracted configuration when the handle is pivoted to the substantially upright position, and wherein the hose is in the expanded configuration when the handle is pivoted to the reclined position, and wherein the hose is slidably engageable with the motor housing portion when the handle is moved between the substantially upright position and the reclined position.

3. A floor cleaning machine for cleaning a surface, the floor cleaning machine comprising:

a body including a suction nozzle thereon;

a handle pivotably coupled to the body, the handle including a motor housing portion;

a supply tank assembly coupled to the handle;

a suction motor assembly in fluid communication with the suction nozzle and) positioned in the motor housing portion the suction motor assembly operable to draw fluid and dirt from the surface through the suction nozzle;

a recovery tank coupled to the handle in fluid communication with the suction motor assembly to receive and store fluid and dirt drawn through the suction nozzle; and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the hose is in the retracted configuration when the handle is pivoted to the substantially upright position, and wherein the hose is in the expanded configuration when the handle is pivoted to the reclined position, and wherein the motor housing portion includes a substantially cylindrical shape, and wherein the hose assumes a substantially arcuate shape when in the expanded configuration to follow the substantially cylindrical shape of the motor housing portion.

4. The floor cleaning machine of claim 3, wherein the hose wraps around an arc length of the motor housing portion of at least about 30 degrees when in the expanded configuration.

5. The floor cleaning machine of claim 3, wherein the hose wraps around an arc length of the motor housing portion of about 10 degrees or less when in the retracted configuration.

6. The floor cleaning machine of claim 1, wherein the hose at least partially wraps around at least one of a top and a front of the motor housing portion when in the expanded configuration.

7. The floor cleaning machine of claim 1, wherein the suction nozzle includes an inlet adjacent the surface and an outlet, and wherein the hose includes an inlet attached to the outlet of the suction nozzle.

8. A floor cleaning machine for cleaning a surface, the floor cleaning machine comprising:

a body including a suction nozzle thereon;

a handle pivotably coupled to the body, the handle including a motor housing portion;

a supply tank assembly coupled to the handle, a suction motor assembly in fluid communication with the suction nozzle and positioned in the motor housing portion, the suction motor assembly operable to draw fluid and dirt from the surface through the suction nozzle;

a recovery tank coupled to the handle in fluid communication with the suction motor assembly to receive and store fluid and dirt drawn through the suction nozzle; and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the handle includes a recovery tank support portion upon which the recovery tank is positioned, and wherein the hose includes an outlet attached to the recovery tank support portion and in fluid communication with the recovery tank.

9. The floor cleaning machine of claim 1, wherein the hose is configured as a flexible and expandable bellows-type plastic hose.

10. A floor cleaning machine for cleaning a surface, the floor cleaning machine comprising:

a body including a suction nozzle thereon a handle pivotably coupled to the body, including a motor housing portion;

a supply tank assembly coupled to the handle;

a suction motor assembly in fluid communication with the suction nozzle and positioned in the motor housing portion, the suction motor assembly operable to draw fluid and dirt from the surface through the suction nozzle:

a recovery tank coupled to the handle in fluid communication with the suction motor assembly to receive and store fluid and dirt drawn through the suction nozzle, and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the hose is in the expanded configuration when the handle is pivoted to the substantially upright position, and wherein the hose is in the retracted configuration when the handle is pivoted to the reclined position.

11. The floor cleaning machine of claim 10, wherein the hose is engageable with the motor housing portion when the hose is in the retracted configuration and the expanded configuration.

12. The floor cleaning machine of claim 10, wherein the hose is slidably engageable with the motor housing portion when the handle is moved between the substantially upright position and the reclined position.

13. The floor cleaning machine of claim 10, wherein the motor housing portion includes a substantially cylindrical shape, and wherein the hose assumes a substantially arcuate shape when in the expanded configuration to follow the substantially cylindrical shape of the motor housing portion .

14. The floor cleaning machine of claim 13, wherein the hose wraps around an arc length of the motor housing portion of at least about 130 degrees when in the expanded configuration.

15. The floor cleaning machine of claim 13, wherein the hose wraps around an arc length of the motor housing portion of about 90 degrees or less when in the retracted configuration.

16. The floor cleaning machine of claim 10, wherein the hose at least partially wraps around at least one of a bottom and a rear of the motor housing portion when in the expanded configuration.

17. The floor cleaning machine of claim 1, wherein the motor housing portion includes a substantially cylindrical shape defining a central axis, and wherein the central axis extends in a same direction as a pivot axis between the handle and the body.

18. A floor cleaning machine for cleaning a surface, the floor cleaning machine comprising:

a body including a suction nozzle thereon;

a handle pivotably coupled to the body, the handle including a motor housing portion;

a supply tank assembly coupled to the handle, a suction motor assembly in fluid communication with the suction nozzle and positioned in the motor housing portion, the suction motor assembly operable to draw fluid and dirt from the surface through the suction nozzle;

a recovery tank coupled to the handle in fluid communication with the suction motor assembly to receive and store fluid and dirt drawn through the suction nozzle; and an expandable hose fluidly communicating the recovery tank and the suction nozzle, wherein the hose is in one of a retracted configuration and an expanded configuration when the handle is pivoted to a substantially upright position, wherein the hose is in the other of the retracted configuration and the expanded configuration when the handle is pivoted to the reclined position, and wherein the hose at least partially wraps around the motor housing portion when in the expanded configuration, wherein the motor housing portion includes a substantially cylindrical shape defining a central axis, and wherein the central axis extends in a same direction as a pivot axis between the handle and the body, and wherein the central axis is coaxial with the pivot axis.

* * * * *